US005201457A

United States Patent [19]

Kitayama et al.

[11] Patent Number: 5,201,457

[45] Date of Patent: Apr. 13, 1993

[54] PROCESS FOR MANUFACTURING CORROSION-RESISTANT WELDED TITANIUM ALLOY TUBES AND PIPES

[75] Inventors: Shiroh Kitayama, Kobe; Yoshiaki Shida, Ikoma, both of Japan

[73] Assignee: Sumitomo Metal Industries, Ltd., Osaka, Japan

[21] Appl. No.: 729,213

[22] Filed: Jul. 12, 1991

[30] Foreign Application Priority Data

Jul. 13, 1990 [JP] Japan ..... 2-186724

[51] Int. Cl.[5] ..... B21D 39/00

[52] U.S. Cl. ..... 228/144; 148/671

[58] Field of Search ..... 228/232, 263.21, 144; 72/700; 148/11.5 F, 12.7 B, 133, 421, 417, 420

[56] References Cited

U.S. PATENT DOCUMENTS

| | | | |
|---|---|---|---|
| 4,543,132 | 9/1985 | Berczik et al. | 148/421 |
| 4,581,077 | 4/1986 | Sukuyama | 148/12.7 B |
| 4,600,449 | 7/1986 | White | 148/421 |
| 4,634,478 | 1/1987 | Shimogori | 148/421 |
| 4,796,798 | 1/1989 | Tsuta | 228/146 |
| 5,076,858 | 12/1991 | Huang | 148/2 |

FOREIGN PATENT DOCUMENTS

| | | | |
|---|---|---|---|
| 0163001 | 12/1981 | Japan | 72/700 |
| 0005606 | 1/1989 | Japan | 72/700 |
| 2198144 | 6/1988 | United Kingdom | 420/417 |

*Primary Examiner*—Richard K. Seidel
*Assistant Examiner*—James Miner
*Attorney, Agent, or Firm*—Burns, Doane, Swecker & Mathis

[57] ABSTRACT

A process for manufacturing welded titanium alloy tubes and pipes having good corrosion resistance and good mechanical properties from a titanium alloy which consists essentially, by weight, of one or more of the platinum group metals in a total amount of 0.01–0.14%, at least one of Ni and Co each in an amount of 0.1%–2.0%, not more than 0.35% of oxygen, not more than 0.30% of iron, optionally at least one of Mo, W, and V each in an amount of 0.1%–2.0%, and a balance of Ti. The process comprises preparing a slab by hot working from an ingot of the titanium alloy after heating in a temperature range of from 750° C. to a temperature 200° C. above the beta-transus point, hot-rolling the slab with a finishing temperature of not lower than 400° C. to form a hot-rolled strip after heating in a temperature range of from 650° C. to a temperature 150° C. above the beta-transus point, optionally performing annealing in a temperature range of from 550° C. to a temperature 20° C. above the beta-transus point, and/or cold-rolling followed by such annealing, forming and welding the strip to form a tube or pipe, and optionally heat-treating the welded tube or pipe in a temperature range of from 400° C. to a temperature 20° C. above the beta-transus point.

20 Claims, 1 Drawing Sheet

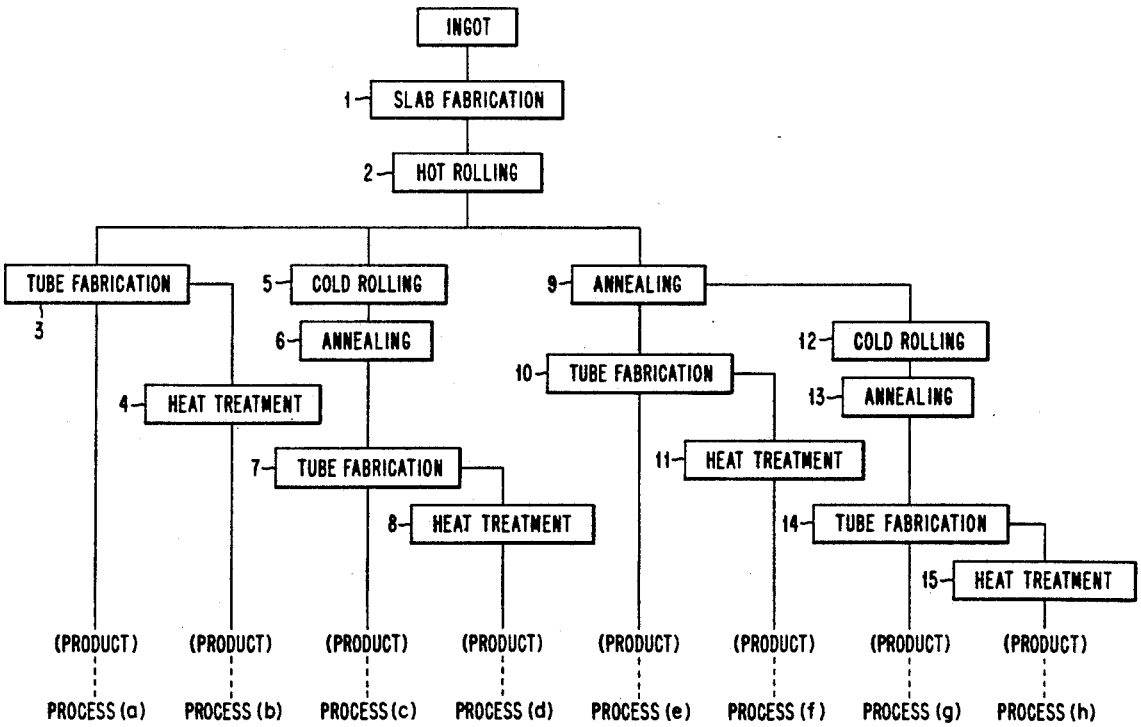

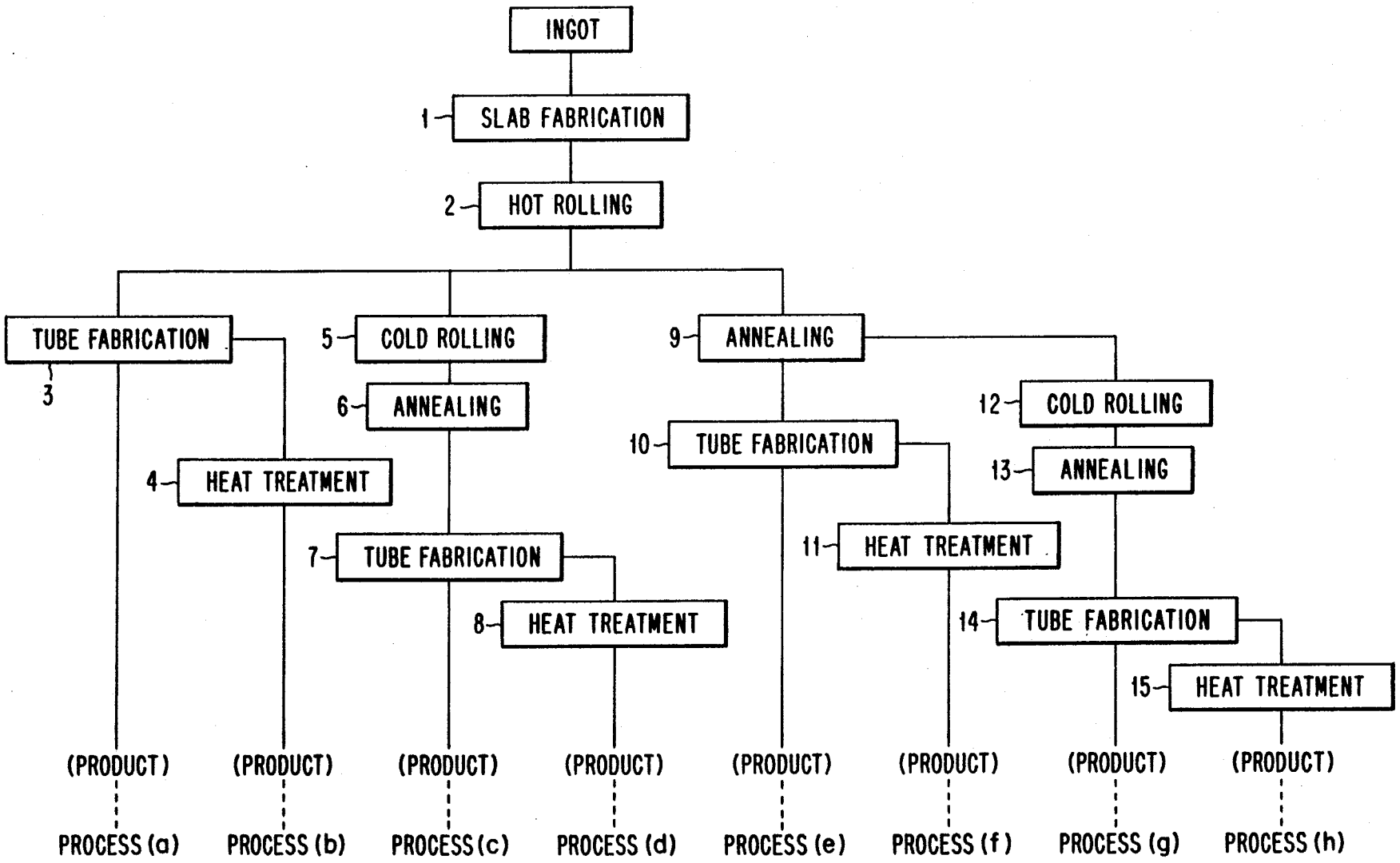
INGOT
SLAB FABRICATION
1
HOT ROLLING
2
TUBE FABRICATION
3
HEAT TREATMENT
4
COLD ROLLING
5
ANNEALING
6
TUBE FABRICATION
7
HEAT TREATMENT
8
ANNEALING
9
TUBE FABRICATION
10
HEAT TREATMENT
11
COLD ROLLING
12
ANNEALING
13
TUBE FABRICATION
14
HEAT TREATMENT
15
(PRODUCT)
PROCESS (a)
(PRODUCT)
PROCESS (b)
(PRODUCT)
PROCESS (c)
(PRODUCT)
PROCESS (d)
(PRODUCT)
PROCESS (e)
(PRODUCT)
PROCESS (f)
(PRODUCT)
PROCESS (g)
(PRODUCT)
PROCESS (h)

PROCESS FOR MANUFACTURING CORROSION-RESISTANT WELDED TITANIUM ALLOY TUBES AND PIPES

BACKGROUND OF THE INVENTION

This invention relates to a process for manufacturing welded tubes and pipes (hereinafter collectively referred to as "welded tubes") from an inexpensive titanium alloy having improved resistance to crevice corrosion and to acids. More particularly, it relates to a process for manufacturing welded titanium alloy tubes having improved corrosion resistance in environments inducing severe crevice corrosion or in non-oxidizing acid environments, which pure titanium metal can no longer withstand.

Titanium has good corrosion resistance in sea water and in oxidizing acids such as nitric acid and it is widely used as a material for condensers in nuclear power stations and heat-exchanger tubes in chemical plants. However, its resistance to crevice corrosion is poor in high-temperature corrosive environments containing chloride ions. Therefore, titanium alloys containing 0.12%–0.25% by weight of palladium (Ti—0.12/0.25Pd) as specified in ASTM grade 7 or 11 (or JIS Classes 11 to 13) are recommended for use in such environments. The use of these alloys which contain expensive Pd metal in a relatively large amount is limited due to their high costs.

An attempt has been made to develop a more economical titanium alloy having resistance to crevice corrosion. Japanese Unexamined Patent Application Kokai Nos. 62-107041(1987), 62-149836(1987), 64-21040(1989), and 64-21041(1989) disclose corrosion-resistant titanium alloys which contain relatively small amounts of one or more of the platinum group metals, one or two of Ni and Co, and optionally one or more of Mo, W, and V.

In order to apply these titanium alloys to actual products, a commercial manufacturing process of the products should be established so as to make it possible to efficiently manufacture products having optimum properties. This is important since the properties of titanium and titanium alloys significantly vary depending on the manufacturing process and conditions, especially working and heating conditions.

Particularly in the manufacture of welded tubes, such as for use in heat exchangers, it is impossible to provide a product having both good mechanical properties and good corrosion resistance unless all the steps from the fabrication of a slab and a hot-rolled or cold-rolled coil or strip to final heat treatment are performed under properly controlled conditions. However, the optimal conditions for the manufacture of welded titanium alloy tubes have not been investigated sufficiently in the past. Thus, there is a need to establish a process and conditions for the commercial manufacture of corrosion-resistant welded titanium alloy tubes of good quality.

SUMMARY OF THE INVENTION

It is an object of the present invention to provide a process for manufacturing welded tubes of good quality from an inexpensive titanium alloy having a relatively low content of the platinum group metals.

Another object of the invention is to provide a process for manufacturing welded titanium alloy tubes which have improved resistance to corrosion, particularly to crevice corrosion, and which can be satisfactorily used as brine heaters in a seawater desalination plant and as heat-exchanger tubes exposed to concentrated brine, such as heat-exchanger tubes used in a salt manufacturing plant, or heat-exchanger tubes exposed to a sulfur dioxide-containing wet environment.

These objects can be accomplished by manufacturing welded tubes from an inexpensive, versatile titanium alloy having good resistance to crevice corrosion and high deformability.

The present invention provides a process for manufacturing welded titanium alloy tubes having good resistance to crevice corrosion from a titanium alloy which consists essentially, on a weight basis, of one or more of the platinum group metals in a total amount of 0.01–0.14%, at least one of Ni and Co each in an amount of 0.1%–2.0%, not more than 0.35% of oxygen, not more than 0.30% of iron, optionally at least one of Mo, W, and V each in an amount of 0.1%–2.0%, and a balance of Ti, the process comprising the steps of:

preparing a slab by hot working from an ingot of the titanium alloy after the ingot has been heated in a temperature range of from 750° C. to a temperature 200° C. above the beta-transus point:

hot-rolling the slab with a finishing temperature of not lower than 400° C. to form a hot-rolled strip after the slab has been heated in a temperature range of from 650° C. to a temperature 150° C. above the beta-transus point;

optionally performing the following processes (i) and/or (ii) on the hot-rolled strip:

(i) annealing the hot-rolled strip in a temperature range of from 550° C. to a temperature 20° C. above the beta-transus point; and/or (ii) cold-rolling the hot-rolled strip to form a cold-rolled strip followed by annealing in a temperature range of from 550° C. to a temperature 20° C. above the beta-transus point;

forming and welding the hot-rolled and optionally annealed and/or cold-rolled strip to form a tube; and optionally subjecting the welded tube to heat treatment in a temperature range of from 400° C. to a temperature 20° C. above the beta-transus point.

BRIEF DESCRIPTION OF THE DRAWINGS

The sole FIGURE is a flow diagram of the process of the present invention.

DESCRIPTION OF THE INVENTION

A first feature of the present invention is the use as a starting material of a titanium alloy which contains a relatively small amount of at least one of the platinum group metals, Ni and/or Co, and optionally one or more other alloying elements.

A second feature of the invention is the determination of optimal conditions for various steps involved in the manufacture of welded tubes from the above-described titanium alloy, particularly fabrication and hot rolling of a slab, cold rolling, welding into a tube, and heat treatment, and the starting material, i.e., an ingot of the titanium alloy is subjected to various combinations of these steps as shown in the FIGURE, thereby manufacturing corrosion-resistant welded tubes of good quality without a significant loss of the excellent chemical and mechanical properties of the starting material.

In the following description, percent refers to percent by weight unless otherwise indicated.

The titanium alloy used as a starting material in the process of the present invention consists essentially of one or more of the platinum group metals (Ru, Rh, Pd, Os, Ir, and Pt) in a total amount of from 0.01% to 0.14%, at least one of Ni and Co each in an amount of from 0.1% to 2.0%, not more than 0.35% of oxygen, not more than 0.30% of iron, optionally at least one of Mo, W, and V each in an amount of from 0.1% to 2.0%, and a balance of Ti. Such an alloy composition is selected for the following reasons.

(i) Platinum group metals (Ru, Rh, Pd, Os, Ir, and Pt):

The addition of at least one of the platinum group metals as an alloying element is effective to improve the corrosion resistance of a titanium alloy, including its resistance to crevice corrosion and its resistance to acids. Among these elements, Pd and Ru are preferred since they are less expensive and more effective for improving the corrosion resistance than the other platinum group elements. When added to titanium as an alloying element, the effect of Pd on improvement in crevice corrosion resistance is greater than that of a comparable amount (by percent) of Ru. Therefore, Pd is the most preferable. The improvement in corrosion resistance is appreciable when the total amount of the platinum group metals is 0.01% or more, and the improvement becomes more significant as the content increases. However, in the presence of Ni and/or Co as a co-alloying element, the effect of the platinum group metals tends to saturate when the total amount thereof exceeds 0.14%. In addition, the incorporation of such a large amount of the platinum group metals greatly increases the material cost and promotes hydrogen absorption by the alloy. Therefore, the total amount of the platinum group metals is in the range of 0.01%–0.14% and preferably 0.03%–0.10%.

(ii) Cobalt (Co) and Nickel (Ni):

Co and Ni serve to strengthen the passivated film formed on the surface of titanium, which is necessary for titanium to have corrosion resistance. More specifically, these elements are precipitated as $Ti_2Co$ and $Ti_2Ni$, respectively, which lower the hydrogen overpotential, thereby serving to maintain and strengthen the passive state of titanium. Furthermore, the presence of these precipitates in the passivated film has the effect of decreasing the current density required to maintain the passive state. When Co or Ni is added to titanium along with the platinum group metals, it has a significant effect of strengthening and stabilizing the passivated film of titanium, particularly in the presence of the platinum group metals having a content lower than the typical content in conventional Ti-Pd alloys (about 0.2%), thereby improving the corrosion resistance of the resulting titanium alloy in non-oxidizing acids such as hydrochloric acid and sulfuric acid.

These effects of Co and Ni as alloying elements become appreciable when at least one of them is added in an amount of 0.1% or more along with the platinum group metal. Therefore, the minimum content of each of these elements is 0.1%. However, when the content of Co or Ni is over 2.0%, the amount of precipitated $Ti_2Co$ or $Ti_2Ni$ increases so much that the resulting alloy becomes so hard that its ductility cannot be maintained at a desirable level, and the manufacture and use of welded tubes will be interfered with. Consequently, the maximum content of each of Co and Ni, which may be added either alone or in combination, is 2.0%. Preferably, one or both of Co and Ni are added in an amount of 0.2% to 1.2%. When alloyed with titanium, the effect of Co on improvement in crevice corrosion resistance is greater than that of a comparable amount (by percent) of Ni.

(iii) Oxygen (O):

A heat exchanger for gases is generally operated at a high pressure in order to improve the transport and production efficiency. Tubes applicable to such a heat exchanger must possess high strength and adequate deformability. Oxygen can be added to increase the strength of titanium due to its effect on solid solution hardening. However, when the oxygen content is over 0.35%, the deformability of the alloy is undesirably impaired from the standpoint of commercial use. Therefore, the maximum oxygen content is 0.35% and preferably 0.25%. In those applications where a high strength, such as a value for 0.2% proof stress of at least 35 $kgf/mm^2$, is required, it is preferred that the oxygen content be 0.15% or greater.

(iv) Iron (Fe):

Fe has the effect of improving the strength of titanium as well as its deformability under hot working. However, the presence of Fe in an excessively large amount adversely affects the corrosion resistance. In order to avoid such an adverse effect of Fe, the Fe content should be at most 0.30% and preferably at most 0.15%.

(v) Molybdenum (Mo), tungsten (W), and vanadium (V):

These alloying elements dissolve in a solution which the alloy contacts in use and form molybdate ions, tungstate ions, and vanadate ions, respectively, which have an oxidizing action and are effective to stabilize the passivated film formed on the surface of the titanium alloy and improve the resistance to corrosion, particularly to crevice corrosion. Therefore, when it is greatly desired to improve the resistance to corrosion and particularly to crevice corrosion, one or more of Mo, W, and V may be added as optional alloying elements.

However, when the content of each of these elements is less than 0.1%, the corrosion resistance including crevice corrosion resistance cannot be improved appreciably. The addition of an excessively large amount of these elements adversely affects the deformability of the alloy. Therefore, the content of each of Mo, W, and V, when added, should be in the range of 0.1%–2.0% and preferably 0.5%–1.5%. When two or more of these elements are added, it is desirable that the total amount thereof be in the range of 0.1%–2.0%.

The balance of the titanium alloy used as a starting material in the present invention is essentially titanium (Ti), i.e., it consists of Ti and incidental impurities.

Welded tubes are manufactured from the above-described titanium alloy starting material by subjecting it to one of the manufacturing processes (a) to (h) shown in the FIGURE. In the following description, (a) to (h) and (1) to (15) refer to manufacturing processes and steps, respectively, illustrated in the accompanying FIGURE.

Process (a)

Welded tubes are fabricated from a hot-rolled strip by the following Steps (1) to (3).

(1) Fabrication of slab

A titanium alloy ingot is heated to a temperature range of from 750° C. to a temperature 200° C. above the beta-transus point of the alloy and hot-working is applied to the heated ingot by means of forging and/or rolling to form a slab.

Since the quality of a slab largely influences the basic properties of a hot-rolled strip from which a welded tube product is fabricated, the slab should be prepared carefully. Specifically, it is important that the slab have a uniform quality and be free from both compositional defects, such as foreign matter and segregates, and structural defects of the slab such as voids, cracks, and laminations.

In order to eliminate compositional defects, the starting materials used to prepare the titanium alloy ingot should be controlled carefully during melting to form an ingot. The melting of the starting materials can be performed in the same manner as for conventional titanium alloys, i.e., in a vacuum or in an inert gas atmosphere by vacuum arc melting, electron beam melting, plasma beam melting, or induction melting.

The titanium alloy ingot may be heated using any heat source which can control the heating atmosphere so as not to cause embrittlement of titanium by hydrogen absorption.

In order to eliminate structural defects of a slab, the ingot should be carefully processed to form a slab as described below. The preparation of a slab from an ingot can be performed by forging, rolling, or a combination of both. The main purpose of these procedures are to improve the microstructure of the alloy material and to impart a shape adapted for the subsequent fabrication step.

Whether the working is performed by forging or rolling alone or by a combination of forging and rolling, the heating temperature prior to each of such working should not be higher than 200° C. above the beta-transus point. If the ingot is heated to a higher temperature, the oxide layer formed on the surface of a forged or rolled slab will grow and the material will be softened excessively to such a degree that the uniformity of deformation will be impaired and the surface roughness and flatness of the resulting slab will be undesirably increased. In this case, the rough and uneven surface must be removed by machining, leading to an increase in man-hours of labor and a decrease in yield.

The minimum heating temperature is approximately 750° C. from the standpoint of deformability. If the heating temperature is lower than 750° C., successful working will be difficult due to an increase in deformation resistance and a decrease in deformability and the resulting slab will have surface or internal structural defects such as laps and cracks. Surface defects can be removed by machining, but machining is disadvantageous with respect to man-hours of labor and yield. Internal defects may cause sheet fracture or formation of surface defects such as scabs or cracks during the subsequent hot rolling and optional cold rolling.

Preferably the heating temperature is in the range of from 850° C. to a temperature 150° C. above the beta-transus point and more preferably from 900° C. to a temperature 150° C. above the beta-transus point. (2) Hot rolling The slab produced in the above-mentioned Step (1) is hot-rolled to form a hot-rolled strip after it has been heated to a temperature range of from 650° C. to a temperature 150° C. above the beta-transus point. The heating temperature is preferably in the range of from 700° C. to a temperature 150° C. above the beta-transus point and more preferably from 750° C. to a temperature 100° C. above the beta-transus point.

In Steps (1) and (2), the heating temperature should be maintained until the hot working is started, that is, it should be substantially the same as the initial hot working temperature. If a temperature drop during transportation from a heating furnace to a rolling mill is not negligible, the heating temperature may be slightly higher than that defined herein.

When the slab is hot-rolled at a temperature higher than 150° C. above the beta-transus point, folding defects or scratches tend to form during hot rolling. At a temperature lower than 400° C., surface defects such as scabs will often be formed due to a decrease in deformability. Therefore, the finishing temperature of the hot rolling should be 400° C. or above, preferably 500° C. or above, and more preferably 600° C. or above and below the beta-transus point.

(3) Tube fabrication by welding

The hot-rolled strip of a titanium alloy obtained in Step (2) is formed and welded to fabricate a tube. Prior to tube fabrication, the surface oxide layer (scale) of the hot-rolled strip is removed by a suitable descaling technique and the strip is slitted or sheared to dimensions which conform to the size of the welded tube to be manufactured and then formed into a tubular section having an open joint. The joint is then closed by welding to produce a welded tube.

Various methods can be employed in tube fabrication depending on the size and thickness of the tube to be manufactured.

The hoop can be formed into a tubular section by various techniques including roll forming, spiral forming, bending roll forming, and U-O press forming. After the hoop is formed, the joint is welded.

The welding may be performed by TIG (tungsten inert-gas) arc welding, plasma arc welding, laser welding, or a combination of plasma arc welding and TIG arc welding.

For example, continuous production of a welded tube having a wall thickness of not greater than 3 mm can be performed in the following manner.

A hoop obtained from the hot-rolled strip by slitting to a width corresponding to the circumference of the welded tube followed by coiling is rerolled and then passed through a roll former having a breakdown roll and a fin-pass roll to form the hoop into a tubular section. While the tubular section is pressed so as to make the opposite ends of the joint abut by passing through a pair of squeeze rolls, the butt joint of the hoop is welded. Welding can be performed in a conventional manner. TIG arc welding can be conducted by passing a direct current through a tungsten negative electrode and the titanium alloy hoop as an positive electrode. Plasma arc welding utilizes a plasma arc generated between a tungsten electrode and the hoop through a small-bore nozzle within a plasma jet torch. Laser welding or a combination of TIG arc welding and plasma arc welding may also be employed.

Titanium has a strong affinity for oxygen, hydrogen, and nitrogen. Moreover, once titanium reacts with these gases, the resulting reaction products, which are difficult to remove, embrittle the alloy. Therefore, it is highly desirable that the hoop be welded in an inert gas atmosphere.

A welded tube having a wall thickness of greater than 2 mm may be produced by TIG arc welding while a filler rod made of the same titanium alloy as the hoop is melted in accordance with the multi-layer, build-up welding technique. In special cases, vacuum electron beam welding may be employed.

Preferable welding conditions for each welding method are as follows.

1) TIG arc welding

TIG arc welding can be performed under conditions in which the welding current (I) and welding speed (V) satisfy the following inequalities:

$$100\times(T)^{\frac{1}{2}}\leqq I\leqq 400\times(T)^{\frac{1}{2}} \quad (1)$$

$$0.5/T\leqq V\leqq 5.0/T \quad (2)$$

where T: hoop thickness (mm),

I: welding current (A), and V: welding speed (m/min).

At a welding current lower than the minimum value defined by Inequality (1) or at a welding speed higher than the maximum value defined by Inequality (2), incomplete penetration may occur in the weld zone. When the welding current is higher than the maximum value defined by Inequality (1) and the welding speed is also higher than the maximum value defined by Inequality (2), the generated weld zone may have undesirable weld defects. For example, humping beads may be formed thereby creating discontinuous melt holes, or undercuts may be formed. At a welding current higher than the maximum value defined by Inequality (1) and a welding speed lower than the minimum value defined by Inequality (2), the weld beads formed may be undesirably protruded inwardly in the interior of the tube. As a whole, it is difficult to obtain a sound weld zone under conditions in which either Inequality (1) or (2) is not satisfied.

In order to avoid embrittlement of the titanium alloy in the weld zone by absorption of atmospheric oxygen, nitrogen, or hydrogen, the outer and inner surfaces of the hoop and the resulting tube should be shielded from air by sealing with an inert gas such as argon. When the temperature of the weld zone falls to about 350° C. or below, titanium is no longer susceptible to oxidation. Therefore, until the temperature of the weld zone falls to about 350° C. after welding, it is preferable to seal the weld zone with an inert gas. The optimum flow rate of the sealing gas can be determined by the welding conditions, such as the plate thickness, welding speed, and welding heat input.

2) Plasma arc welding

Plasma arc welding can be performed under conditions defined by the following inequalities:

$$100\times(T)^{\frac{1}{2}}\leqq I\leqq 400\times(T)^{\frac{1}{2}} \quad (3)$$

$$0.5/T\leqq V\leqq 8.0/T \quad (4)$$

Compared to TIG arc welding, the width of weld beads can be smaller and a higher welding speed can be selected with plasma arc welding. A torch height of about 5 mm is sufficient for plasma arc welding.

3) High-frequency pulsed TIG arc welding

High-frequency (H-F) pulsed TIG arc welding can be performed under conditions defined by the following inequalities:

$$I_p\leqq 400\times(T)^{\frac{1}{2}} \quad (5)$$

$$100\times(T)^{\frac{1}{2}}\leqq I_B \quad (6)$$

$$0.5/T\leqq V\leqq 8.0/T \quad (7)$$

where $I_p$: peak current (A), and $I_B$: overall average current (A).

The pulse frequency is preferably at least 1 kHz and more preferably at least 5 kHz.

When the values for $I_p$ and V both exceed the maximum values defined by Inequalities (5) and (7), respectively, undesirable humping beads or undercut may be formed. Even when the value for $I_B$ is equal to or larger than the minimum value defined by Inequality (6), inward protrusion of weld beads may occur if the value for V is smaller than the minimum value defined by Inequality (7).

A pulse frequency of less than 1 kHz is not preferable since fine reverse side beads characteristic of pulsed arc TIG cannot be obtained.

4) Combination of plasma arc welding and TIG arc welding

Compared to TIG arc welding, plasma arc welding can be performed at a higher speed, but there is a tendency for the bead surface formed by welding to be roughened and recessed by the action of the gas flow impinging against the beads. This problem can be overcome by a combination of plasma arc welding and TIG arc welding.

According to this method, after the butt joint is fused and bonded by plasma arc welding, the resulting rough bead surface is subjected to an arc generated by TIG arc welding, thereby eliminating the surface roughness and producing a smooth bead surface.

The initial plasma arc welding can be performed under the same conditions described in section (2) above, and the subsequent TIG arc welding can be performed with a weld current satisfying the following inequality:

$$100\times(T)^{\frac{1}{2}}\leqq I\leqq 250\times(T)^{\frac{1}{2}} \quad (8)$$

5) Carbon dioxide laser welding

According to this welding method, the energy of a laser beam can be concentrated through a focusing mirror so that there is no limitation on the thickness of the plate to be welded.

Laser welding can be performed under conditions which satisfy the following inequality:

$$\frac{T\times V}{W}\leqq 5 \quad (9)$$

where

W: output (kw).

Under conditions in which the output does not satisfy Inequality (9), incomplete penetration may occur in the weld zone, resulting in incomplete bonding of the joint.

Laser welding is particularly suitable for tube fabrication at a high speed or with a thick wall, and the width of weld beads can be varied widely by changing the beam energy density, which can be controlled by adjustment of a focusing mirror.

Following welding which can be performed by various welding methods as described above, the resulting welded tube is passed through a straightener and a sizer to improve its straightness and roundness and then is cut to an appropriate length as a final stage of the tube fabrication step.

Process (b)

A welded tube obtained in the manner described in Process (a) is subjected to the following heat treatment step (4) for release of residual stress.

(4) Heat treatment

When it is desired to improve the ductility of the welded tube, the tube obtained in the tube fabrication step is subjected to heat treatment. The heat treatment is classified as residual stress annealing, full annealing, or beta-annealing, depending on the purpose thereof. (Residual stress annealing)

When the titanium alloy tube is used in an environment where stress-corrosion cracking is likely to occur, the residual stress of the tube should be removed. For this purpose, the tube is annealed in a temperature range of 400°-600° C. The holding time depends on the annealing temperature. For example, several seconds are sufficient for annealing at 600° C. to attain the desired effect, while it takes 5 minutes or longer when annealing at 400° C. The residual stress cannot be removed to a substantial degree by annealing at a temperature lower than 400° C.

When the heat treatment is conducted in air for more than 60 minutes at a relatively high temperature, e.g., above 600° C., attention should be given to the atmosphere so as not to cause absorption of hydrogen and other undesirable gases by the titanium alloy tube. (Full annealing)

In order to effect full annealing, the tube is heat-treated at a temperature higher than 600° C. If such heat treatment is conducted in air, not only does the tube undergo severe oxidation but it also absorbs hydrogen, resulting in a decrease in deformability. Therefore, heat treatment for full annealing is preferably conducted in an inert gas or in a vacuum.

Beta-annealing

Titanium and a titanium alloy form a deformation texture during rolling and their properties in the rolling direction are different from those in the cross direction. For example, with respect to tensile properties, they have a higher 0.2% proof stress or yield point in the cross direction than in the rolling direction. Particularly in cases where it is desired to reduce such anisotropic behavior of the tube, the tube is annealed in the beta temperature region.

As in full annealing, care should be taken to use an atmosphere which will protect the surface of the tube from oxidation, nitriding, and other undesirable reactions.

If the tube is annealed at an excessively high temperature above the beta-transus point, the grains significantly coarsen and the deformability is decreased. In addition, the tube loses its shape due to the strain resulting from the transformation. However, when the annealing temperature is at most 20° C. above the beta-transus point, undesirable anisotropy can be eliminated or reduced and the above-mentioned problems can be avoided.

For the reasons discussed above, the temperature for heat treatment after tube fabrication is restricted to from 400° C. to a temperature 20° C. above (preferably below) the beta-transus point.

As described above, heat-treatment is preferably performed in an inert gas or a vacuum. Although heat treatment can be conducted in air, annealing in air at a temperature above 600° C. results in the formation of a hardened layer on the surface of the tube due to oxidation and nitriding. Since the hardened layer inhibits the deformability of the titanium alloy, it should be removed by a suitable descaling method after the heat treatment.

Descaling methods which can be used include mechanical descaling methods such as brushing and shot blasting, chemical descaling methods using an acid or a molten salt, and a combination of mechanical and chemical methods.

Process (c)

Subsequent to step (2) in Process (a), i.e., after a hot-rolled strip is prepared in the manner described in Process (a), the hot-rolled strip is subjected to a cold-rolling step (5), annealing step (6), and tube fabrication step (7) to manufacture a welded tube. This process is suitable for the manufacture of welded tubes having relatively thin walls. The cold-rolling step (5) and the subsequent annealing step (6) may be performed repeatedly.

(5) Cold rolling

The hot-rolled strip obtained in Step (2) is cold-rolled using a suitable mill such as a reversing mill, tandem mill, or Sendzimir mill to prepare a mother sheet for tube fabrication. Since the hot-rolled strip has an oxide scale formed on its surface by hot working and since such scale may cause cracking or other problems during cold working, it is preferable to remove the surface scale prior to cold rolling by a mechanical or chemical descaling method as described above or by a combination of mechanical and chemical descaling methods.

The cold-rolling speed is preferably 1400 m/min or less. Although a higher cold-rolling speed can be employed, it is advisable in view of the relatively high cost of the titanium alloy to avoid rolling at an excessively high speed in order to eliminate rolling failure.

A lubricating oil is used in cold rolling for lubrication and cooling. Since the cold-rolled strip is then subjected to annealing and welding, the lubricating oil deposited on the surface of the cold-rolled strip should be removed by washing.

(6) Annealing

Since the strip obtained in cold rolling step (5) is work-hardened due to the cold working, it is annealed to restore ductility.

The annealing temperature depends on the reduction ratio in cold rolling which is calculated by the following formula:

$$\text{Reduction Ratio} = (T - T')/T \times 100$$

where

T = plate thickness before rolling, and

T' = plate thickness after rolling.

As a rough measure, the annealing temperature should be 550° C. or above when the reduction ratio in cold rolling is more than 90% and 600° C. or above when the reduction ratio is 90% or less.

Annealing at a temperature lower than 550° C. does not cause recrystallization to a sufficient degree to provide the strip with a desired level of ductility.

Usually it is preferable to conduct vacuum annealing or continuous annealing at a temperature below the beta-transus point. However, as described above, the anisotropy of titanium is relatively large and the yield point or proof stress of a low-alloy titanium material in the cross direction is higher than in the rolling direction. When such anisotropy is unacceptable, it is desirable to anneal the cold-rolled strip at a temperature above the beta-transus point in order to eliminate or at least reduce the anisotropy. In view of the fact that annealing at a temperature much higher than the beta-transus point results in the formation of significantly coarsened grains, leading to a decrease in deformability, and also causes the tube to lose its shape due to the strain resulting from the transformation, the upper limit of the annealing temperature is 20° C. above and preferably 20° C. below the beta-transus point.

Annealing in air causes the formation of an oxide scale, which dissolves in the weld zone during the subsequent welding, and the weld zone is undesirably embrittled. In order to eliminate this problem, the oxide scale is removed prior to welding by a suitable descaling method as mentioned above.

The annealed strip is then slitted to an appropriate width and subjected to the tube fabrication step.

(7) Tube fabrication

The annealed strip is processed for the fabrication of a welded tube in the same manner as described above with respect to the tube fabrication step (3) of Process (a).

Process (d)

The welded tube obtained by Process (c) is subjected to a heat-treatment step (8) after the tube fabrication step (7).

(8) Heat treatment

The heat treatment can be performed in the same manner as described above in regard to Step (4) of Process (b).

Process (e)

Subsequent to the hot-rolling step (2) in Process (a), the hot-rolled strip is subjected to an annealing step (9) and tube fabrication step (10) to manufacture a welded tube.

(9) Annealing

Although the material to be annealed is a hot-rolled strip, the purposes of annealing are the same as when annealing a cold-rolled strip. Therefore, this annealing step can be performed under the same conditions as described above with respect to the annealing step (6) after cold rolling. However, in this case, the hot-rolled strip obtained in Step (2) has an oxide scale formed on its surface by the hot working. Since the oxide scale causes cracking or other defects during subsequent cold working, it is preferable to remove the scale prior to annealing.

(10) Tube fabrication

The annealed strip is processed to produce a welded tube in the same manner as described above in regard to the tube fabrication step (3) of Process (a).

Process (f)

The welded tube obtained by Process (e) is subjected to a heat-treatment step (11) after the tube fabrication step (10).

The heat treatment can be performed under the same conditions as described above for Step (4) of Process (b).

Process (g)

Subsequent to the annealing step (9) in Process (e), the annealed hot-rolled strip is subjected to a cold-rolling step (12), annealing step (13) and tube fabrication step (14) to manufacture a welded tube. The cold-rolling step (12) and the subsequent annealing step (13) may be performed repeatedly.

These steps may be performed under the same conditions as described above for Steps (5), (6), and (7), respectively.

Process (h)

The welded tube obtained by Process (g) is subjected to a heat-treatment step (15) after the tube fabrication step (14).

The heat treatment can be performed under the same conditions as described above for Step (4) of Process (b).

According to the process of the present invention, welded tubes can be manufactured in a stable manner from a relatively inexpensive titanium alloy having good corrosion resistance and good mechanical properties without adversely affecting these properties. The welded tubes manufactured by the process of the present invention can be used as tubing and piping for various types of facilities and equipment used in severe corrosive environments.

The following example is presented to describe the invention more fully. It should be understood, however, that the specific details set forth in the example are merely illustrative and the present invention is not restricted by the example.

EXAMPLE

Titanium alloy ingots each measuring 970 mm in diameter and 1000 mm in length (weighing about 3.5 tons) and having the composition shown in Table 1 were prepared from a blend of pure titanium sponge and powdery alloying metals by briquetting, welding to form a primary electrode and vacuum arc remelting. After the periphery of the ingots were machined to a diameter of 965 mm, the ingots were processed by the following steps so as to make welded titanium alloy tubes according to one of the above-described Processes (a) to (h). The beta-transus points of these titanium alloys were in the range of 860°–930° C.

(1) Fabrication of slab

A slab measuring 150 mm thick by 1050 mm wide by 4690 mm long was fabricated from each titanium alloy ingot by either (i) hot forging alone or (ii) hot forging followed by hot rolling. The forging was performed on a 3,000 ton press after the ingot was heated at a temperature of 970°–1050° C. for 6 hours in a gas-fired furnace. When the hot forging was followed by hot rolling, the forging was performed so as to form a forged product measuring 460 mm thick by 1050 mm wide by 1530 mm long, which was then heated at 930°–950° C. for 5.5 hours in a walking beam-type gas-fired furnace and then hot-rolled through a rolling mill having vertical and horizontal rolls to form a slab of the above site.

(2) Hot rolling

After the surface of the slab obtained in Step (1) was machined by a planer and the front and rear ends thereof were gas-cut for shaping and removal of surface flaws, the slab was heated at a temperature in the range of 850°–910° C. for 5 hours in a gas-fired furnace and hot-rolled by continuous rolling or repeated rolling optionally after the slab was passed through reverse rolls to reduce the thickness to 80 mm. The continuous rolling was performed using 6-high tandem mills to obtain a 4.5 mm-thick hot-rolled strip. The repeated rolling was performed on a 80 mm-thick, 1 m-long plate using 4-high rolling mills while the plate was heated two times at 880° C. in a batch-type heating furnace and a hot-rolled plate measuring 8 mm thick by 1050 mm wide by 10 m long was obtained and air-cooled. In all the hot rolling operations, the finishing temperature was around 720° C.

After the hot rolling, the surface of the hot-rolled strip or plate was cleaned by mechanical descaling (shot blasting and belt grinding) and/or chemical descaling (using a salt bath and/or a pickling solution) to remove the oxide scale layer formed on the surface thereof.

Prior to tube fabrication, the strip or plate was slitted to a width corresponding to the length of the outer circumference of the tube product.

Each welded tube was fabricated by one of the above-described processes (a) to (h). The conditions for each step of the processes employed in this example are summarized in Table 2 along with the size of the tube product obtained. Table 3 shows the welding conditions used in the example.

The slab-making step (1) and hot-rolling step (2) were performed under the conditions described above, while the other steps were carried out under the following conditions.

Tube fabrication in Step (3)

The hot-rolled plate obtained in Step (2) which had been descaled was sheared to a width of 795 mm and formed into a tubular section by press forming and the joint was welded by the TIG arc welding method using a filler rod having the same composition as the titanium alloy material used. The welding conditions are shown in Table 3.

Heat treatment in Steps (4), (8), (11), and (15)

The welded tube was heat-treated by heating in a batch-type vacuum furnace at 650° C. or by continuous annealing at 550° C. in an argon atmosphere.

Cold rolling in Step (5)

The hot-rolled strip obtained in Step (2) which had been mechanically descaled was cold-rolled by reverse-type 6-high rolling mills to form a 1.6 mm-thick cold-rolled strip, which was then degreased and rinsed with water.

Annealing in Steps (6), (9), and (13)

The hot-rolled strip or plate or cold-rolled strip was annealed by vacuum annealing or continuous annealing in air or argon. The vacuum annealing was performed in a batch-type vacuum furnace at 650° C. after the strip was descaled or degreased and it took about 20 hours from the start of heating to the end of cooling. The continuous annealing employed in Step (9) was performed in a tunnel furnace at 725° C. in air directly on the hot-rolled plate obtained in step (2) without descaling and the annealed strip was then mechanically descaled.

Cold rolling in Step (12)

The annealed strip obtained in Step (9) by vacuum annealing was cold-rolled in continuous 20-high Sendzimir mills to form a 1.6 mm-thick cold-rolled strip, which was then washed.

Tube fabrication in Steps (7) and (14)

Tube fabrication was performed using a continuous tube-forming machine equipped with forming rolls and squeeze rolls and using the welding method shown in Table 2. The width of the hoop used was 77.2 mm in Step (7) or 58.2 mm in Step (14). Welding was performed under the conditions shown in Table 3.

Tube fabrication in Step (10)

The hot-rolled plate which had been annealed in air and descaled in Step (9) was sheared to 795 mm in width and 3000 mm in length and degreased. It was then formed into a tubular section according to the bending roll method and welded by $CO_2$ laser under the conditions shown in Table 3.

The resulting welded tubes produced by one of Processes (a) to (h) were evaluated with respect to metallographical texture, surface properties, corrosion resistance, and mechanical properties by the following testing methods.

a. Metallographical test

A radial cross section of the tube was observed to examine the texture.

b. Surface observation

The surface of the tube was observed visually and the presence or absence of defects was determined by microscopic observation of a cross section and by a penetration test.

c. Tensile test

A tensile test was performed on a 350 mm-long test piece, which was either a sheet-like test piece cut from a thick-walled, large-diameter tube obtained by Process (a), (b), (e), or, (f) or a tube-shaped test piece cut from a thin-walled, small-diameter tube obtained by the other process. The gage length of the test piece was 50 mm. The strain rate was 0.5% per minute until a 0.2% proof stress was applied, and was 20% per minute between the 0.2% proof stress and breaking.

d. Crevice corrosion test

A plurality of test pieces taken from the tube were spaced apart from each other by winding polytetrafluoroethylene (PTFE) spacers around them or by forcing the spacers against them to form crevices between them, and the test pieces were then subjected to a crevice corrosion test. The crevice corrosion test was performed using a salt solution containing 250 g/l of NaCl and a sufficient amount of HCl to adjust the pH of the solution to 2. The test pieces were immersed in the salt solution for 500 hours at 200° C.

After the test, the surface of the crevice was observed visually and the occurrence of crevice corrosion was determined by the presence of a corrosion product.

e. Corrosion resistance test in hydrochloric acid

A plurality of sheet-like or tube-shaped test pieces taken from the tube were immersed in a boiling 3% hydrochloric acid solution for 200 hours and the resistance to hydrochloric acid was evaluated in terms of corrosion rate (in mm per year) which was calculated from the weight loss by corrosion.

The test results are shown in Table 1.

TABLE 1

| Run No. | Chemical Composition (wt % Ti-bal.) Pd | Ru | Other Platinum group metal | Co | Ni | Mo | W | V | O | Fe | Resistance to crevice corrosion | Corrosion rate (mm/year) | 0.2% proof stress (kgf/mm$^2$) | Tensile strength (kgf/mm$^2$) | Elongation (%) | Overall evaluation | Manufacturing process of the figure employed |
|---|---|---|---|---|---|---|---|---|---|---|---|---|---|---|---|---|---|
| 1* | 0.02 | | | | | | | | 0.04 | 0.04 | Δ | 0.50 | 21.1 | 33.2 | 46 | x(A) | (a) |
| 2 | 0.02 | | | 0.5 | | | | | 0.04 | 0.04 | O | 0.10 | 24.8 | 35.3 | 51 | O | (d) |
| 3 | 0.05 | | | 0.3 | | | | | 0.05 | 0.05 | O | 0.04 | 22.3 | 33.5 | 47 | O | (h) |
| 4 | 0.12 | | | 0.2 | | | | | 0.05 | 0.04 | O | 0.01 | 23.3 | 34.1 | 41 | O | (e) |
| 5 | 0.06 | | | 1.8 | | | | | 0.04 | 0.04 | O | 0.01 | 40.5 | 45.5 | 35 | O | (b) |
| 6 | 0.05 | | | | 0.5 | | | | 0.05 | 0.04 | O | 0.12 | 28.1 | 38.6 | 42 | O | (c) |
| 7 | 0.10 | | | | 0.3 | | | | 0.05 | 0.05 | O | 0.07 | 23.1 | 34.1 | 42 | O | (f) |
| 8 | 0.03 | | | | 1.5 | | | | 0.04 | 0.05 | O | 0.11 | 38.5 | 44.3 | 39 | O | (d) |
| 9 | 0.05 | | | | 0.2 | 0.7 | | | 0.05 | 0.05 | O | 0.06 | 30.1 | 37.2 | 41 | O | (e) |
| 10 | 0.05 | | | 0.2 | | | 0.8 | | 0.04 | 0.04 | O | 0.06 | 28.5 | 39.3 | 34 | O | (b) |
| 11 | 0.05 | | | | 0.1 | | | 1.2 | 0.05 | 0.04 | O | 0.06 | 33.3 | 44.1 | 43 | O | (h) |
| 12 | 0.05 | | | 0.3 | 0.4 | | | | 0.04 | 0.05 | O | 0.06 | 36.5 | 46.8 | 38 | O | (g) |
| 13 | 0.06 | | | 0.3 | | 0.4 | | | 0.05 | 0.04 | O | 0.03 | 30.1 | 43.3 | 42 | O | (b) |
| 14 | 0.05 | | | 0.4 | | | 0.4 | | 0.04 | 0.04 | O | 0.03 | 31.4 | 42.5 | 40 | O | (d) |
| 15 | 0.05 | | | 0.3 | | | | 0.5 | 0.05 | 0.05 | O | 0.03 | 31.6 | 41.8 | 35 | O | (f) |
| 16 | 0.09 | | | 0.3 | 0.3 | | | | 0.04 | 0.05 | O | 0.01 | 35.4 | 45.1 | 41 | O | (h) |
| 17 | 0.11 | | | 0.3 | | 0.4 | | | 0.05 | 0.05 | O | 0.01 | 35.4 | 46.3 | 37 | O | (c) |
| 18 | 0.10 | | | 0.3 | | | 0.5 | | 0.04 | 0.04 | O | 0.01 | 31.1 | 41.9 | 37 | O | (j) |
| 19 | 0.10 | | | 0.3 | | | | 0.4 | 0.04 | 0.05 | O | 0.01 | 36.3 | 47.2 | 36 | O | (g) |
| 20* | | 0.03 | | | | | | | 0.05 | 0.04 | Δ | 0.55 | 22.1 | 33.5 | 41 | x(A) | (a) |
| 21 | | 0.02 | | 0.5 | | | | | 0.04 | 0.05 | O | 0.15 | 24.4 | 35.2 | 49 | O | (h) |
| 22 | | 0.05 | | 0.5 | | | | | 0.05 | 0.04 | O | 0.04 | 26.3 | 38.7 | 42 | O | (c) |
| 23 | | 0.06 | | 1.0 | | | | | 0.05 | 0.05 | O | 0.03 | 35.6 | 51.3 | 32 | O | (d) |
| 24 | | 0.05 | | | 0.6 | | | | 0.05 | 0.05 | O | 0.06 | 35.2 | 48.4 | 35 | O | (e) |
| 25 | | 0.11 | | 0.5 | | | | | 0.04 | 0.05 | O | 0.02 | 28.4 | 37.7 | 42 | O | (g) |
| 26 | | 0.05 | | 0.3 | 0.3 | | | | 0.04 | 0.05 | O | 0.04 | 28.7 | 37.3 | 40 | O | (b) |
| 27 | | 0.05 | | 0.3 | | 0.6 | | | 0.05 | 0.04 | O | 0.04 | 31.5 | 42.4 | 38 | O | (h) |
| 28 | | 0.05 | | 0.4 | | | 0.4 | | 0.04 | 0.05 | O | 0.04 | 32.3 | 41.9 | 39 | O | (d) |
| 29 | | 0.05 | | 0.4 | | | | 0.6 | 0.04 | 0.04 | O | 0.04 | 31.1 | 42.5 | 34 | O | (f) |
| 30 | | 0.05 | | 1.1 | | | 1.0 | | 0.05 | 0.05 | O | 0.02 | 46.3 | 55.6 | 25 | O | (a) |
| 31 | | 0.05 | | | 1.0 | | 1.0 | | 0.05 | 0.05 | O | 0.05 | 45.8 | 56.3 | 22 | O | (c) |
| 32 | | 0.05 | | 0.8 | 0.3 | 0.6 | | | 0.05 | 0.04 | O | 0.05 | 38.7 | 51.4 | 24 | O | (f) |
| 33 | | | Ir 0.05 | 0.4 | | | | | 0.04 | 0.04 | O | 0.05 | 31.4 | 43.3 | 35 | O | (g) |
| 34 | | | Pt 0.05 | 0.5 | | | | | 0.04 | 0.04 | O | 0.05 | 32.3 | 43.9 | 41 | O | (e) |
| 35 | | | Rh 0.05 | 0.3 | | | | | 0.05 | 0.05 | O | 0.05 | 25.1 | 37.2 | 40 | O | (b) |
| 36 | 0.05 | | Pt 0.05 | 0.4 | | | | | 0.04 | 0.05 | O | 0.01 | 28.9 | 41.2 | 35 | O | (e) |
| 37 | 0.03 | 0.03 | | 0.3 | | | | | 0.04 | 0.04 | O | 0.01 | 25.2 | 37.4 | 43 | O | (f) |
| 38 | 0.07 | 0.04 | | 0.3 | | | | | 0.04 | 0.05 | O | 0.01 | 30.4 | 39.5 | 42 | O | (g) |
| 39 | 0.04 | 0.07 | | 0.3 | | | | | 0.05 | 0.04 | O | 0.01 | 30.5 | 40.1 | 39 | O | (a) |
| 40 | | | Ir 0.03, Os 0.03, Pt 0.03, Rh 0.03 | 0.3 | 0.3 | | | | 0.05 | 0.05 | O | 0.02 | 30.3 | 41.5 | 42 | O | (d) |
| 41 | 0.05 | | | 0.3 | | | | | 0.08 | 0.05 | O | 0.04 | 26.5 | 38.6 | 45 | O | (g) |
| 42 | 0.05 | | | 0.3 | | | | | 0.15 | 0.05 | O | 0.06 | 34.1 | 41.3 | 41 | O | (g) |
| 43 | 0.05 | | | 0.3 | | | | | 0.20 | 0.05 | O | 0.04 | 36.2 | 43.4 | 38 | O | (h) |
| 44 | 0.05 | | | 0.3 | | | | | 0.25 | 0.25 | O | 0.02 | 37.4 | 50.1 | 34 | O | (h) |
| 45 | 0.05 | | | 0.3 | | | 0.3 | | 0.10 | 0.15 | O | 0.03 | 40.2 | 52.4 | 25 | O | (e) |
| 46 | 0.05 | | | | 0.3 | 0.4 | | | 0.25 | 0.24 | O | 0.03 | 40.3 | 52.6 | 30 | O | (h) |
| 47 | 0.05 | | | 0.3 | | 0.3 | | | 0.25 | 0.25 | O | 0.02 | 51.6 | 60.4 | 25 | O | (h) |
| 48 | 0.03 | 0.03 | | 0.3 | | | | | 0.20 | 0.15 | O | 0.02 | 50.3 | 58.3 | 23 | O | (f) |
| 49 | 0.03 | 0.02 | | | 0.4 | | | | 0.18 | 0.05 | O | 0.02 | 34.6 | 45.4 | 38 | O | (d) |

TABLE 1-continued

| Run No. | Chemical Composition (wt % Ti-bal.) Pd | Ru | Other Platinum group metal | Co | Ni | Mo | W | V | O | Fe | Resistance to crevice corrosion | Corrosion rate (mm/year) | 0.2% proof stress (kgf/mm$^2$) | Tensile strength (kgf/mm$^2$) | Elongation (%) | Overall evaluation | Manufacturing process of the figure employed |
|---|---|---|---|---|---|---|---|---|---|---|---|---|---|---|---|---|---|
| 50 | | 0.05 | | 0.3 | | | | | 0.20 | 0.08 | O | 0.02 | 37.1 | 47.2 | 29 | O | (a) |
| 51 | | 0.05 | | | 0.5 | | | | 0.18 | 0.05 | O | 0.04 | 32.5 | 43.4 | 31 | O | (f) |
| 52 | | 0.05 | | 0.3 | 0.3 | | | | 0.08 | 0.05 | O | 0.03 | 33.5 | 44.7 | 35 | O | (c) |
| 53 | | 0.05 | | 0.5 | | | 0.5 | | 0.10 | 0.05 | O | 0.03 | 39.3 | 49.4 | 33 | O | (e) |
| 54 | | 0.05 | | | 0.4 | | 0.6 | | 0.10 | 0.05 | O | 0.03 | 38.3 | 48.5 | 33 | O | (f) |
| 55* | | | | | | | | | 0.08 | 0.06 | x | 7.48 | 27.5 | 36.3 | 40 | x(A) | (b) |
| 56* | | | | | 0.8 | 0.3 | | | 0.14 | 0.09 | Δ | 3.62 | 45.2 | 63.5 | 28 | x(A) | (e) |
| 57* | 0.18 | | | | | | | | 0.08 | 0.05 | O | 0.02 | 24.2 | 36.5 | 40 | x(B) | (b) |
| 58 | 0.05 | | | 0.3 | | | | | 0.30 | 0.10 | O | 0.11 | 42.3 | 53.6 | 15 | O | (e) |
| 59* | 0.02 | | | 0.3 | | | | | 0.08 | 0.42 | Δ | 0.51 | 48.3 | 55.5 | 10 | x(A) | (e) |
| 60* | 0.05 | | | 3.0 | | | | | 0.25 | 0.20 | O | 0.02 | 65.1 | 88.3 | 4 | x(C) | (f) |
| 61* | | 0.05 | | | 2.5 | | | | 0.30 | 0.25 | O | 0.02 | 63.3 | 78.8 | 5 | x(C) | (a) |
| 62* | | 0.05 | | 1.0 | | | | | 0.42 | 0.15 | O | 0.02 | 58.2 | 65.5 | 7 | x(C) | (a) |

(Notes)
*Comparative run in which the alloy does not have a composition defined herein.
Resistance to crevice corrosion: O = no crevice corrosion occurred, Δ = slight crevice corrosion occurred, x = severe crevice corrosion occurred.
Overall evaluation: (A) Poor corrosion resistance, (B) High material costs, (C) Poor elongation.

TABLE 2

| Process | (1) Slab | (2) Hot rolling | (3) Welding | (4) Heat treating | (5) Cold rolling | (6) Annealing | (7) Welding | (8) Heat treating | (9) Annealing | (10) Welding | (11) Heat treating | (12) Cold rolling | (13) Annealing | (14) Welding | (15) Heat treating | Final product |
|---|---|---|---|---|---|---|---|---|---|---|---|---|---|---|---|---|
| (a) | Forged at 1050–870° C. | Hot rolled at 880–720° C., 4-high mills | TIG arc welding, 3 layers build-up | — | — | — | — | — | — | — | — | — | — | — | — | 25.4 ϕ 7.5 l |
| (b) | Forged at 1050–870° C. | Hot rolled at 880–720° C., 4-high mills | TIG arc welding, 3 layers build-up | 650° C. vacuum annealing | — | — | — | — | — | — | — | — | — | — | — | 25.4 ϕ 7.5 l |
| (c) | Forged at 1000–850° C. and hot-rolled at 930–800° C. | Hot rolled at 850–720° C. continuous rolling | — mills | — vacuum | 6-high arc | 650° C. annealing | plasma welding | — | — | — | — | — | — | — 1.6 l | — | 25.4 ϕ |
| (d) | Forged at 1000–850° C. and hot-rolled at 930–800° C. | Hot rolled at 850–720° C. continuous rolling | — | — | 6-high mills | 650° C. vacuum annealing | plasma arc welding | 550° C. in Ar, continuous | — | — | — | — | — | — | — | 25.4 ϕ 1.6 l |
| (e) | Forged at 970–800° C. | Hot rolled at 880–720° C. 4-high mills | — | — | — | — | — | — | 725° C. in air, continuous | $CO_2$ laser welding | — | — | — | — | — | 25.4 ϕ 7.5 l |
| (f) | Forged at 970–800° C. | Hot rolled at 880–720° C. 4-high mills | — | — | — | — | — | — | 725° C. in air, continuous | $CO_2$ laser welding | 650° C. vacuum annealing | — | — | — | — | 25.4 ϕ 7.5 l |
| (g) | Forged at 1050–870° C. and hot-rolled at 950–800° C. | Hot rolled at 910–720° C. continuous rolling | — — | — — | — — | — — | — — | — — | 650° C. vacuum annealing | — | — | 20-high Sendzimir mill | 650° C. vacuum annealing | H-F pulsed TIG arc welding | — | 19.0 ϕ 1.6 l |
| (h) | Forged at 1050–870° C. and hot-rolled at 950–800° C. | Hot rolled at 910–720° C. continuous rolling | — — | — — | — — | — — | — — | — — | 650° C. vacuum annealing | — | — | 20-high Sendzimir mill | 725° C. in Ar, continuous | H-F pulsed TIG arc welding | 650° C. vacuum annealing | 19.0 ϕ 1.6 l |

(Note)
ϕ: outer diameter (mm),
l: wall thickness (mm).

TABLE 3

| Process - Step | Welding method | Welding current | Welding voltage | Output | Welding speed | Shielding gas |
|---|---|---|---|---|---|---|
| (a) - (3)<br>(b) - (3) | TIG arc*<br>3-layer build-up | 300 A | 15 V | — | 0.3 m/min | 99.99% Ar |
| (c) - (7)<br>(d) - (7) | plasma arc welding* | — | — | 100 KVA<br>450 kHz | 1.9 m/min | 99.99% Ar |
| (e) - (10)<br>(f) - (10) | carbon dioxide laser | — | — | 4 kW | 0.8 m/min | 99.99% Ar |
| (g) - (14)<br>(h) - (14) | H-F** pulsed TIG | average 200 A<br>peak 320 A | 15 V | — | 2.0 m/min | 99.99% Ar |

(Notes)
*Using a tungsten electrode measuring 3.2 mm in diameter.
**High-frequency of 15 kHz.

As is apparent from the results shown in Table 1, the titanium alloys used in the present invention which contain a relatively small amount of the platinum group metals in combination with Co and/or Ni and optionally one or more of Mo, W, and V exhibit excellent crevice corrosion resistance comparable to that of the conventional, expensive Ti-0.2Pd alloy.

Titanium alloys to which only Pd or Ru is added do not have satisfactory crevice corrosion resistance when the content of Pd or Ru is 0.02% or 0.03% (Run Nos. 1 and 20). However, the addition of 0.5% Co to such alloys significantly improves the crevice corrosion resistance (Run Nos. 2 and 21). Similarly, the addition of Ni, or Co and Ni, or one or both of Co and Ni along with one or more of Mo, W, and V to a titanium alloy containing a small amount of Pd, Ru, or other platinum group metal results in a significant improvement in corrosion resistance including crevice corrosion resistance and provides a titanium alloy having corrosion resistance which is far superior to that of pure titanium (Run No. 55) or a titanium alloy of ASTM Grade 12 (Run No. 56).

When oxygen and/or Fe is added for improving the strength, the corrosion resistance of the resulting alloys is not degraded and their ductility remains at a satisfactory level as long as the oxygen content is not more than 0.35% (Run No. 58). In contrast, a titanium alloy containing more than 0.35% oxygen has a decreased ductility (Run No. 62) while that containing more than 0.3% Fe has decreased elongation and resistance to acids (Run No. 59).

The ductility of titanium alloys containing Co or Ni in an excessively large amount is decreased to such a degree that they are no longer useful for practical applications (Run Nos. 60 and 61).

Some of the welded tubes were subjected to a flattening test by downwardly compressing a test tube with the weld zone on the side between two flat plates. The welded tube of Run No. 3 (19.0 mm Φ) caused no crack when flattened to 5 mm in the distance between the flat plates. The welded tube of Run No. 37 (254 mm Φ) could be flattened to 100 mm without cracking, while that of Run No. 52 (25.4 mm Φ) caused no crack when flattened to 15 mm.

The welded tubes shown in Table 1 were produced by one of the processes shown in Table 2 which all satisfy the conditions of the present invention. All the processes employed in the example proceeded smoothly and resulted in the production of welded tubes which were free from surface defects and which had a texture of completely recrystallized grains.

For comparison, welded tubes were produced under the following conditions which did not fall within the conditions defined by the present invention. The starting material used in this comparative test was an ingot of a titanium alloy having a composition of Ti—0.05 Pd—0.3 Co—0.19 oxygen—0.05 Fe having a diameter of 980 mm and a length of 2,000 mm.

(1) Preparation of slab under improper conditions

When a slab was prepared in the same manner as above except that the heating temperature before hot rolling was 1200° C., the resulting slab had an excessively thick and uneven surface oxide layer and the surface of the slab had to be machined by a thickness of about 25 mm in order to obtain a smooth surface suitable for the subsequent step.

(2) Hot rolling under improper conditions

The slab was hot-rolled by continuous rolling after being heated to 1150° C. The surface of the resulting hot-rolled strip had many defects such as scratches and scabs and a number of man-hours of labor was required to remove these defects.

(3) Annealing of welded tube under improper conditions

Welded tubes obtained by Process (e) were annealed at 350° C. The residual stress in the circumferential direction was 20 kgf/mm$^2$ before the annealing and it remained unchanged after the annealing at 350° C.

(4) Annealing under improper conditions before tube fabrication

A cold-rolled strip was annealed at 450° C. and a welded tube was fabricated from the annealed strip. Since the residual stress of the cold-rolled strip could not be removed sufficiently by the annealing which was performed at an excessively low temperature, the resulting welded tube was affected by the heat applied during welding and had corrugated bead portions in the weld zone. In addition, the shape of the tube was deformed into an elliptical cross section and it could not be corrected.

Although the invention has been described with respect to preferred embodiments, it is to be understood that variations and modifications may be employed without departing from the concept of the invention as defined in the following claims.

What is claimed is:

1. A process for manufacturing a welded titanium alloy tube or pipe having good resistance to crevice corrosion from a titanium alloy which consists essentially, by weight, of one or more of the platinum group metals in a total amount of 0.01–0.14%, at least one of Ni and Co each in an amount of 0.1%–2.0%, not more than 0.35% of oxygen, not more than 0.30% of iron, optionally at least one of Mo, W, and V each in an amount of 0.1%-2.0%, and a balance of Ti, the process comprising the steps of:

(1) preparing a slab by hot working from an ingot of the titanium alloy after the ingot has been heated in a temperature range of from 750° C. to a temperature 200° C. above the beta-transus point;

(2) hot-rolling the slab with a finishing temperature of not lower than 400° C. to form a hot-rolled strip after the slab has been heated in a temperature range of from 650° C. to a temperature 150° C. above the beta-transus point; and (3) forming and welding the hot-rolled strip to form a welded tube or pipe.

2. The process of claim 1 which further comprises the step of:

(4) subjecting the welded tube or pipe to heat treatment in a temperature range of from 400° C. to a temperature 20° C. above the beta-transus point.

3. The process of claim 2 wherein the heat treatment comprises continuous annealing.

4. The process of claim 1 wherein the hot-rolled strip obtained in Step (2) is subjected to the following Steps (5), (6), and (7) to form a welded tube or pipe:

(5) cold-rolling the hot-rolled strip to form a cold-rolled strip;

(6) annealing the cold-rolled strip in a temperature range of from 550° C. to a temperature 20° C. above the beta-transus point; and (7) forming and welding the annealed strip to form a welded tube or pipe.

5. The process of claim 4 wherein Steps (5) and (6) are performed repeatedly.

6. The process of claim 4 which further comprises the step of:

(8) subjecting the welded tube or pipe to heat treatment in a temperature range of from 400° C. to a temperature 20° C. above the beta-transus point.

7. The process of claim 4 wherein the titanium alloy consists essentially, by weight, of one or more of the platinum group metals in a total amount of 0.03%-0.10%, at least one of Ni and Co each in an amount of 0.2%-1.2%, not more than 0.25% of oxygen, not more than 0.15% of iron, optionally at least one of Mo, W, and V each in an amount of 0.5%-1.5%, and a balance of Ti.

8. The process of claim 1 wherein the hot-rolled strip obtained in Step (2) is subjected to the following Steps (9) and (10) to form a welded tube or pipe:

(9) annealing the hot-rolled strip in a temperature range of from 550° C. to a temperature 20° C. above the beta-transus point; and

(10) forming and welding the annealed strip to form a welded tube or pipe.

9. The process of claim 8 which further comprises the step of:

(11) subjecting the welded tube or pipe to heat treatment in a temperature range of from 400° C. to a temperature 20° C. above the beta-transus point.

10. The process of claim 8 wherein the annealed hot-rolled strip obtained in Step (9) is subjected to the following Steps (12), (13), and (14) to form a welded tube or pipe:

(12) cold-rolling the annealed hot-rolled strip to form a cold-rolled strip;

(13) annealing the cold-rolled strip in a temperature range of from 550° C. to a temperature 20° C. above the beta-transus point; and (14) forming and welding the annealed strip to form a welded tube or pipe.

11. The process of claim 10 wherein Steps (12) and (13) are performed repeatedly.

12. The process of claim 10 which further comprises the step of:

(15) subjecting the welded tube or pipe to heat treatment in a temperature range of from 400° C. to a temperature 20° C. above the beta-transus point.

13. The process of claim 8 wherein the titanium alloy consists essentially, by weight, of one or more of the platinum group metals in a total amount of 0.03%-0.10, at least one of Ni and Co each in an amount of 0.2%-1.2%, not more than 0.25% of oxygen, not more than 0.15% of iron, optionally at least one of Mo, W, and V each in an amount of 0.5%-1.5%, and a balance of Ti.

14. The process of claim 8 wherein the annealing comprises continuous annealing the hot-rolled strip in an air atmosphere.

15. The process of claim 1 wherein the titanium alloy consists essentially, by weight, of one or more of the platinum group metals in a total amount of 0.03%-0.10%, at least one of Ni and Co each in an amount of 0.2%-1.2%, not more than 0.25% of oxygen, not more than 0.15% of iron, optionally at least one of Mo, W, and V each in an amount of 0.5%-1.5%, and a balance of Ti.

16. The process of claim 1 wherein the ingot is heated in a temperature range of from 850° C. to a temperature 150° C. above the beta-transus point before hot working.

17. The process of claim 1 wherein the slab is heated in a temperature range of from 700° C. to a temperature 150° C. above the beta-transus point before hot rolling.

18. The process of claim 1 wherein the ingot is heated to a temperature above the beta-transus prior to the hot working step.

19. The process of claim 1 wherein the slab is heated to a temperature above the beta-transus prior to the hot-rolling step.

20. The process of claim 1 wherein the hot rolling finishing temperature is below the beta-transus.

* * * * *